US006638336B1

(12) United States Patent
Drozdenko et al.

(10) Patent No.: US 6,638,336 B1
(45) Date of Patent: Oct. 28, 2003

(54) MANUFACTURE OF COST-EFFECTIVE TITANIUM POWDER FROM MAGNESIUM REDUCED SPONGE

(76) Inventors: Victor A. Drozdenko, 27 Gudimenko St. #20, Zaporizhzhya (UA), 69113; Anatoli M. Petrunko, 4 Mayakovsky Dr. #50, Zaporizhzhya (UA), 69035; Anatoli E. Andreev, 6 Verkhnya St. #23, Zaporizhzhya (UA), 69032; Oleksiy P. Yatsenko, 25 Marshal Chuykov St. #59, Zaporizhzhya (UA), 69096; Orest M. Ivasishin, 31 General Naumov St. #40, Kiev (UA), 03164; Dmitro G. Savvakin, 9 Ave. of 50-years Zhovtnya #313, Kiev (UA), 03194; Vladimir S. Moxson, 2525 Deer Hollow, Hudson, OH (US) 44236; Francis H. Froes, 2475 Blaine Rd., Moscow, ID (US) 83843

( * ) Notice: Subject to any disclaimer, the term of this patent is extended or adjusted under 35 U.S.C. 154(b) by 0 days.

(21) Appl. No.: 10/145,532

(22) Filed: May 13, 2002

(51) Int. Cl.[7] ..... B22F 9/04; B22F 9/28
(52) U.S. Cl. ..... 75/359; 75/360; 75/364
(58) Field of Search ..... 75/354, 357, 359, 75/360, 364

(56) References Cited

U.S. PATENT DOCUMENTS

| | | | | | |
|---|---|---|---|---|---|
| 4,175,110 | A | * | 11/1979 | Tolley | 423/83 |
| 4,373,947 | A | * | 2/1983 | Buttner et al. | 75/228 |
| 5,422,069 | A | * | 6/1995 | Perfect | 419/45 |
| 6,210,461 | B1 | * | 4/2001 | Elliott | 75/344 |
| 6,475,428 | B1 | * | 11/2002 | Fraval et al. | 419/23 |

* cited by examiner

*Primary Examiner*—George Wyszomierski

(57) ABSTRACT

The cost-effective titanium powder is manufactured by (a) magnesium-thermic reduction of titanium chlorides characterized by the formation of a hollow block of the reaction mass having an open cavity in the center of the block, (b) thermal-vacuum separation of the hollow block from excessive Mg and $MgCl_2$ at 850–950° C. and residual pressure of $10^{-2}$–$10^{-3}$ mm Hg, (c) cooling of obtained titanium hollow block in a $H_2$-contained atmosphere at an excessive hydrogen pressure, (d) crushing the hydrogenated titanium block, (e) grinding the crushed titanium pieces into the powder combined with a hydro-metallurgical treatment of obtained titanium powder in a diluted aqueous solution of at least one chloride selected from magnesium chloride, sodium chloride, potassium chloride, or titanium chloride, and (f) drying and, optionally dehydrating the titanium powder ground to a predetermined particle size. The formation of the hollow block of the reaction mass with the open cavity in the center of the block is carried out by accelerating the reaction mass on the inside surface of the reactor. The hydro-metallurgical treatment of titanium powder is carried out in the solutions having the total content of chlorides of 0.5–10 wt. %, at the powder-to-solution weight ratio from 1:1 to 1:4. The cooling of the titanium hollow block in the hydrogen-contained atmosphere is carried out to the temperature of 550–450° C. at the excessive hydrogen pressure of 0.2 bar or higher. The productivity of the innovative process is higher, the energy consumption is lessened more than double, the duration of the processing cycle is decreased by 3. The shorter time of high-temperature stages results in significant improvement of titanium powder quality because it prevents the oxidation and nitrogenation of the metal. The powder dispersion is increased caused by porous and poorly sintered structure of the reaction mass. Cooling the block in the presence of hydrogen also increases the powder quality and the yield of fine powder fractions during the hydro-metallurgical treatment.

5 Claims, No Drawings

MANUFACTURE OF COST-EFFECTIVE TITANIUM POWDER FROM MAGNESIUM REDUCED SPONGE

FIELD OF INVENTION

The present invention relates to titanium powder manufactured by crushing and grinding titanium sponge produced by metallo-thermic reduction of titanium chlorides. More particularly, the invention is directed to the cost-cutting and energy-saving manufacture of titanium powder by the improved process of magnesium-reduction of $TiCl_4$ including vacuum separation (vacuum distillation) from magnesium and magnesium chlorides followed by the improved process of grinding and hydro-metallurgical treating of the ground sponge.

BACKGROUND OF THE INVENTION

Titanium powder for commercial use, is presently produced by a hydride-dehydride (HDH) process, as disclosed in U.S. Pat. No. 6,168,644, by gas atomization, or by the plasma-rotating electrode process, as disclosed in U.S. Pat. No. 6,136,060. Raw materials for HDH process are titanium metal obtained by re-melting and processing titanium sponge, or ready-crushed titanium sponge itself, as disclosed in JP 10096003, 1998. These raw materials are hydrogenated, then, the brittle hydrogenated titanium is ground to the desired powder size that is dehydrogenated by vacuum heating. Essentially, the titanium powder production is a multi-step, energy-consumable, high-cost industrial process including the manufacture of titanium sponge, which is the most expensive part of the technology.

Numerous disclosures for magnesium-reducing $TiCl_4$ and subsequent processing of the obtained titanium sponge are present in the art, starting from U.S. Pat. No. 2,205,854 granted to Wilhelm Kroll in 1940. Most developments were directed to improve the quality of the sponge by diminishing the final content of magnesium, chlorine, oxygen, and iron contaminants. Various processes have been developed during the last two decades for energy-saving, cost-effective, sponge-related technologies.

For example, Russian patent 2,061,585, 1994, describes the manufacture of titanium powder by (a) magnesium-thermic reduction of titanium chlorides in a reactor, (b) preliminary distillation of the reaction mass to the content of magnesium chloride of 5–12%, (c) cooling of obtained sponge block in argon, (d) crushing and grinding the sponge into the powder having a particle size of 0–12 mm, (e) preliminary drying of the powder at <250° C., (f) cooling and additional grinding, (g) final distillation of the powder from magnesium chloride residues by vacuum separation, (h) hydro-metallurgical treatment, (i) final drying, and (j) final grinding of titanium powder.

In spite of saving time and energy of sponge production, this process is not cost-effective when considering titanium powder as the final product. In this process, the first stage of vacuum separation is carried out at 1020° C., which results in a solid sintered block of the reaction mass and increases the time of sponge distillation. Double-stage vacuum separation accompanied by multi-stage drying and grinding increases the process time and electric energy consumption, and significantly decreases the powder productivity. Besides, multi-stage hot drying increases the content of gaseous impurities in the obtained powder.

Periodic removal of exhaust magnesium chloride from the reactor bottom and cooling a reaction interface by argon flow (disclosed in JP 59001646, 1984) reduced the time of sponge production, but neither the cost nor the energy of the entire process of powder manufacture is gained.

The same result, insignificant to powder cost, was reached in the process disclosed in JP 61012836, 1986 which increases the sponge yield by predetermined blowing of $TiCl_4$ at the temperature of <600° C. under argon into molten magnesium.

The electric power consumption was decreased by 20% using a condensing vessel in the reactor for removing unreacted magnesium and residual magnesium chloride from the reaction zone as disclosed in JP 03047929, 1991. This energy savings related only to sponge production and does not reflect on the total production cost because the obtained ductile sponge needs to be hydrated/dehydrated with the repetition of the multi-stage processing.

An attempt at producing titanium powder directly by the magnesium-thermic reduction of $TiCl_4$ and eliminated all expenses involved with sponge production was made by Uda T. with colleagues (*2nd Int. Conf on Process. Mater. and Properties, TMS*, 2000, p. 31–36). This method looks promising for the future but presently, it is far from an industrial scale. Incidentally, some rather expensive rare-earth metals (e.g., Dy and Ho) are involved in the process.

Productivity of the magnesium-thermic process was increased by the preliminary cleaning of $TiCl_4$ and accelerated the supply into the reactor as disclosed in Russian patent 2,145,979, 2000. This method also related only to the sponge production and results mostly in the sponge quality.

A way of accelerating the distillation stage was offered by Sandier R. A. and Kholmovskaya N. A. (*Izv. Akad Nauk USSR, Met.*, 1967, 6, p. 58–62). According to this, the oxide impurities are partially soluble in fused $MgCl_2$ at a higher temperature, therefore the reduction process should be carried out at more elevated temperature and simultaneously increase feeding the reactor with $TiCl_4$ to obtain a porous titanium sponge, which facilitates the removal of fused $MgCl_2$ together with oxygen dissolved in it. Unfortunately, the higher temperature results in additional power consumption.

The supply of hot argon through the reaction mass can also speed up the distillation process by vaporizing the magnesium and magnesium chloride in gaseous form, as disclosed in the U.S. Pat. No. 3,880,652. But additional expenses involved with heating and supplying high-temperature argon override the savings on production cost during the distillation stage.

The manufacture of high-purity titanium sponge lumps is disclosed in recent JP 2001262246, 2001. The process includes crushing the titanium sponge to a particle size of 2–50 mm and heat-treating at a reduced argon pressure of 600–1100° C. Crushing and heat treatment are repeated several times until the desired purity of coarse titanium is reached. This method is ineffective for commonly used titanium, and requires HDH processing to obtain the powder for industrial purposes.

All other known methods of producing titanium powder directly from magnesium-reduced sponge have the same drawback: cost and energy savings are only realized for one or two stages, but not for the continuous multi-stage process, which makes none of these processes cost effective.

Not one conventional process comprises the sponge production adjusted specially to subsequent powder manufacture: sponge lumps are ductile and need to be treated by HDH process.

OBJECTS OF THE INVENTION

The object of the invention is to establish a continuous cost-effective process to produce as-reduced titanium powder from titanium sponge obtained by the magnesium-thermic process specially adjusted to subsequent powder manufacturing.

Another objective of the present invention is to control the structure of the reaction mass block to facilitate and accelerate the sponge distillation from magnesium and magnesium chloride residues.

It is yet another objective to produce brittle sponge metal to provide crushing lumps and grinding titanium powder with additional HDH processing.

Another objective of the invention is to find energy-saving combinations of the process stages to achieve a cost effective method for the entire technology.

The nature, utility, and further features of this invention will be more apparent from the following detailed description with respect to preferred embodiments of the invented technology.

SUMMARY OF THE INVENTION

The invention relates to the manufacture of titanium powder by magnesium-thermic reduction of titanium chlorides followed by thermal-vacuum distillation, crushing, grinding. and hydro-metallurgical treatment of the obtained titanium sponge. While the use of magnesium-thermic reduced sponge has previously been contemplated in the titanium powder production as mentioned above, problems related to cost-effectiveness, energy saving, and adjusting the sponge production to facilitate powder manufacturing have not been resolved.

The invention overcomes these problems by (a) magnesium-thermic reduction of titanium chlorides performed in such a way that results in the formation of a hollow block of the reaction mass having an open cavity in the center of the block, (b) thermal-vacuum separation of the hollow block at 850–950° C. and residual pressure of $10^{-2}$–$10^{-3}$ mm, (c) cooling of the titanium hollow block in a $H_2$-contained atmosphere at excessive hydrogen pressure, (d) crushing the hydrogenated titanium block, (e) grinding the crushed titanium pieces into the powder simultaneously with a hydro-metallurgical treatment of obtained titanium powder in a diluted liquid solution of at least one chloride selected from: magnesium chloride, sodium chloride, potassium chloride, or titanium chloride, and (f) drying, and optionally dehydrating the titanium powder ground to a predetermined size.

The formation of the hollow block of the reaction mass with the open cavity in the center of the block is carried out by increasing the reaction mass on the inside surface of the reactor.

The hydro-metallurgical treatment of titanium powder is carried out in the solutions having the total content of chlorides of 0.5–10 wt. %, at the powder-to-solution weight ratio from 1:1 to 1:4.

Cooling of the titanium hollow block in the hydrogen-containing atmosphere is carried out to the temperature of 550–450° C. at the $H_2$ excessive pressure of 0.2 bar or higher.

The hydrogen-contained atmosphere is the gaseous mixture of hydrogen with argon and/or helium.

In essence, the core of the invention is the combination and adjustment of operations directed to titanium sponge production with operations directed to titanium powder production. So, (1) cooling of the reaction block after vacuum distillation is combined with its hydrogenation, (2) the magnesium-thermic reduction is adjusted to subsequent distillation and hydrogenation by forming the hollow block of the reaction mass, (3) hydro-metallurgical treatment of the sponge is combined with powder grinding, and finally, (4) drying of ground titanium powder is combined with dehydrogenation. In other words, the HDH process is included in the process of magnesium-thermic sponge production.

Therefore, the innovative technology results in saving energy, significantly decreases the number of processing stages, and cuts production costs.

DETAILED DESCRIPTION AND PREFERRED EMBODIMENTS OF THE INVENTION

High productivity and energy saving of sponge processing and increasing the quality of titanium powder with respect to its chemical composition and particle size distribution, are achieved by the intensification of each stage of the technology: formation of the hollow block of the reaction mass with an open cavity in the center of the block, vacuum separation at lower temperature, acceleration of the block cooling, and a combination of sponge grinding with the hydro-metallurgical treatment of the powder.

In our innovative process, the magnesium-thermic reduction of the titanium chlorides is carried out at 750–860° C. in an inert atmosphere in the reactor partially filled with liquid magnesium at a controlled supply of $TiCl_4$ with maximal rate to cut the process duration. The reaction mass is formed on the inner surface of the reactor, in which the surface is permanently contacted with molten magnesium. These process conditions result in the growth of the reaction mass on the inner surface of the reactor and subsequently, in the formation of the hollow block of the reaction mass having the open cavity in the center. Such shape of the reaction mass provides a high rate of magnesium reduction, that accelerates the formation of the porous block, and decreases the total duration of the sponge production process. A shorter time of the process results in the significant savings of supplied electric power.

The block obtained on the reduction stage is subjected to thermal-vacuum separation at 850–950° C. and the starting pressure of $10^{-2}$–$10^{-3}$ mm Hg. Evaporation of magnesium and magnesium chlorides happen from both inner and exterior surfaces of the reaction mass block. The open cavity in the center of the block and its developed porosity allow (1) to accelerate the vacuum separation of magnesium and magnesium chloride at the cost of increase in the evaporation surfaces, and (2) to carry out the vacuum separation at lower temperature.

The vacuum separation is finished when the pressure in the reactor reaches the value of $10^{-2}$–$10^{-3}$ mm Hg again. At this moment, an inflow of air is stopped to prevent any oxidation of the obtained sponge and gas atmosphere.

The sponge block is cooled down from 550–450° C. in the hydrogen-argon gaseous mixture having the pressure gauge of 0.2 bar. Then, the reactor is outgassed, filled with argon, and cooled down to <100° C. Cooling of the sponge block after the distillation is also accelerated, initially caused by a hydrogen-argon flow, and then caused by greater contact surface of the block.

Cooling in the hydrogen-containing atmosphere is accompanied with the hydration of the entire mass of the sponge block that facilitates the subsequent crushing and grinding of the sponge as well as reduces time of the hydro-metallurgical treatment of titanium powder. Hydrated sponge increases the yield of dispersed titanium powder during grinding to improve its uniformity and quality.

Crushing and grinding of the hydrated sponge is carried out for only one run, which significantly reduces the electric power consumption as compared to the conventional multi-run grinding of ductile titanium sponge.

Technically, the cold sponge hydrated to 1–3 wt. % of $H_2$ is crushed to coarse grains having an average size up to 5 mm. Then, the coarse titanium is ground in a ball mill filled with aqueous solutions of magnesium chloride, sodium chloride, potassium chloride, or titanium chloride. The weight ratio of titanium powder to steel balls is 1:(4–8).

The combination of grinding with the hydro-metallurgical treatment of titanium powder in diluted chloride solutions also results in a savings of electric power consumption and increased productivity. The chloride concentration in these solutions is limited from 0.5 wt. % on the low side to 10 wt. % on the high side. If the chloride concentration is below 0.5 wt. %, the passivity of the powder does not occur. Exceeding chloride concentration over 10 wt. % is not reasonable because a partial dissolution of titanium powder may occur, and a part of the final product will be lost. The powder-to-solution weight ratio from 1:1 to 1:4 was established experimentally based on the value and the rate of magnesium leaching.

Finally, the obtained titanium powder is dried and, optionally dehydrated in a vacuum.

EXAMPLE

The magnesium-thermic reduction was accomplished in the reactor partially filled with liquid magnesium. The reactor had a bottom permeable by magnesium and magnesium chloride melts. The charge of 960 kg of magnesium was poured into reactor, then, it was heated to 800° C. Titanium tetrachloride was supplied on the magnesium surface with the input rate of 1100 kg/m$^2$ per hour. Total mass of the supplied $TiCl_4$ was 1600 kg, and the duration of the reduction process was 5 hours. The porous block having an open cavity in its center area was obtained, which contained about 40 wt. % of magnesium and about 10 wt. % of magnesium chloride.

The thermal-vacuum separation was carried out at 850° C. during 12 hours down to magnesium chloride content of 3 wt. %, and the process was finished when the pressure in the apparatus reached $10^{-2}$ mm Hg. The sponge block was cooled for 16 hours down to 45° C. in the hydrogen-containing atmosphere, and then, it was crushed in a disk mill to coarse grains having the particle size of ≦5 mm.

Grinding of coarse titanium was carried out for 2 hours in a ball mill with the powder-to-balls weight ratio of 1:6 in the aqueous solution of chlorides of Mg, Na, K, or Ti at their total concentration of 1 wt. % and the titanium powder-to-solution weight ratio of 1:2. The ground titanium powder was released from the mill, washed out, and screened in wet form.

The achieved productivity of the entire process is 10 kg/h, and electric power consumption was 4500 kW/h per 1 ton of the powder. The field of powder having the particle size of −0.63 mm was about 80%. Engineering characteristics of the innovative technology are shown in the table in columns 2, 3, and 4. Examples 3 and 4 reflect only small variations in timing, temperature, and chloride solutions.

COMPARATIVE EXAMPLE

According to Russian Patent 2,061,585, the magnesium reduction process is carried out in a reactor having 1 m diameter with the input rate of $TiCl_4$ supply about 170 kg/m$^2$ per hour. The charge of 1500 kg of magnesium was poured into the reactor, then, it was heated to 800° C. Total mass of $TiCl_4$ supplied on the magnesium surface was 3550 kg, and the duration of the reduction process was 30 hours. A thin sintered block containing about 35 wt. % of magnesium and about 15 wt. % of magnesium chloride was obtained. Afterwards, a preliminary vacuum separation stage of the block was carried out for 24 hours at 1020° C. down to the content of magnesium chloride about 5 wt. % when pressure in the reactor reached $10^{-2}$ mm Hg.

The distillated block was cooled for 24 hours in argon down to 45° C., then, it was crushed for 10 hours using a hydraulic press and a disk mill in coarse titanium pieces and granules having the grain size of ≦12 mm. Then, the obtained coarse titanium was placed into the apparatus of vacuum separation where a multi-step drying process was performed for 4 hours at primary vacuum value of 0.2 mm Hg and with the temperature increase from 20 to 250° C. After the drying, the coarse titanium was subjected to the final vacuum separation stage for 30 hours at 1000° C.

The obtained sintered coarse titanium was cooled in argon down to 45° C. at pressure of 0.05–0.15 bar, and subjected to a second crushing and grinding in the hydraulic press and the disk mill to achieve the desired particle size.

The productivity of this technology is 6.2 kg/h, and electric power consumption was 7400 kW/h per 1 ton of the powder. The yield of powder having the particle size of −0.63 mm is about 20%. The remainder of the powder is coarser. Engineering characteristics of the technology are shown in the table in column 1.

The comparison of characteristics shown in the table clearly demonstrates a number of advantages of the innovative process: the productivity is higher, the energy consumption is lessened more than double, the duration of the processing cycle is decreased by 3. The shorter time of high-temperature stages results in significant improvement of titanium powder quality because it prevents the oxidation and nitrogenation of the metal. So, the content of oxygen and nitrogen in titanium powder is lower, which is an important indicator of titanium quality. The powder dispersion is increased caused by porous and poorly sintered structure of the reaction mass. Cooling the block in the presence of hydrogen also increases the powder quality and the yield of fine powder fractions during the hydro-metallurgical treatment.

TABLE

Comparative characteristics of conventional and innovative processes

| | Comparative process | Innovative process | | |
|---|---|---|---|---|
| Characteristics | 1 | 2 | 3 | 4 |
| 1. Productivity of the process of Ti powder production, kg/h | 6.2 | 10.0 | 9.2 | 9.4 |
| 2. Electric power consumption, kW/h per 1 ton of powder | 7400 | 4500 | 4750 | 4600 |
| 3. Mass of supplied $TiCl_4$, kg | 3550 | 1600 | 1600 | 1600 |
| 4. Yield of powder −200 mesh (−0.63 mm), % | 20 | 80 | 80 | 60 |
| 5. Total duration of powder production, hours | 140 | 40 | 45 | 44 |
| 6. Temperature of vacuum separation, ° C. | 1020 | 850 | 800 | 1000 |
| 7. Concentration of chlorides | — | 1.0 | 0.3 | 12 |

TABLE-continued

| Comparative characteristics of conventional and innovative processes | | | | |
|---|---|---|---|---|
| | Comparative process | Innovative process | | |
| Characteristics | 1 | 2 | 3 | 4 |
| in hydro-metallurgical solutions, wt. % | | | | |
| 8. Solid-to-liquid ratio in hydro-metallurgical treatment, T:L | — | 1:2 | 1:0.5 | 1:5 |
| 9. Cooling atmosphere | Ar | $H_2$ + Ar | $H_2$ + Ar | $H_2$ + Ar |
| 10. Quantity of process stages | 8 | 5 | 5 | 5 |

We claim:

1. A method of manufacturing titanium powder including the steps of:

(a) magnesium-thermic reduction of titanium chlorides in a reactor resulting in the formation of a hollow block of a reaction mass having an open cavity in the center of the block, (b) thermal-vacuum separation of the hollow block from excessive magnesium and magnesium chloride at 850–950° C. and residual pressure of $10^{-2}$–$10^{-3}$ mm Hg, (c) cooling of obtained titanium hollow block in a hydrogen-containing atmosphere, (d) crushing the hydrogenated titanium block, (e) grinding the crushed titanium pieces into the powder having a predetermined particle size, (f) subjecting the obtained titanium powder to a hydro-metallurgical treatment in a dilute aqueous solution of at least one chloride selected from magnesium chloride, sodium chloride, potassium chloride, or titanium chloride, (g) drying and, optionally dehydrating the ground titanium powder.

2. The manufacture of titanium powder according to claim 1, wherein the formation of the hollow block of the reaction mass with the open cavity in the center of the block is carried out by conducting the magnesium-thermic reduction so that the reaction mass forms on the inner surface of the reactor.

3. The manufacture of titanium powder according to claim 1, wherein the hydro-metallurgical treatment of titanium powder is carried out simultaneously with grinding the crushed titanium pieces into the powder in a solution having the total content of chlorides of 0.5–10 wt. %, at the powder-to-solution ratio from 1:1 to 1:4.

4. The manufacture of titanium powder according to claim 1, wherein cooling of the titanium hollow block in the hydrogen-containing atmosphere is carried out to the temperature of 550–450° C. at the excessive hydrogen pressure of 0.2 bar or higher.

5. The manufacture of titanium powder according to claim 4, wherein the hydrogen-containing atmosphere is a gaseous mixture of hydrogen with argon and/or helium.

* * * * *